US008549813B2

(12) United States Patent
Martter

(10) Patent No.: US 8,549,813 B2
(45) **Date of Patent: *Oct. 8, 2013**

(54) REINFORCING ASSEMBLY AND REINFORCED STRUCTURE USING A REINFORCING ASSEMBLY

(76) Inventor: Richard P. Martter, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/187,311

(22) Filed: Jul. 20, 2011

(65) Prior Publication Data

US 2012/0137619 A1 Jun. 7, 2012

Related U.S. Application Data

(63) Continuation-in-part of application No. 12/959,912, filed on Dec. 3, 2010, now Pat. No. 8,220,219.

(51) Int. Cl.
*E04H 12/00* (2006.01)

(52) U.S. Cl.
USPC ..... 52/649.1; 52/633

(58) Field of Classification Search
USPC ..... 52/649.1, 633, 680, 677, 682, 687
See application file for complete search history.

(56) References Cited

U.S. PATENT DOCUMENTS

| | | | | |
|---|---|---|---|---|
| 1,620,501 | A | 3/1927 | Vogel | |
| 1,930,957 | A * | 10/1933 | Nester | 404/136 |
| 2,420,860 | A | 5/1947 | Burner | |
| 2,783,695 | A | 3/1957 | De Canio | |
| 3,400,508 | A | 9/1968 | Dietner et al. | |
| 4,406,103 | A | 9/1983 | Ghali et al. | |
| 4,612,747 | A | 9/1986 | Andra et al. | |
| 4,689,867 | A | 9/1987 | Tolliver | |
| 4,865,781 | A | 9/1989 | Jennings | |
| 4,996,816 | A | 3/1991 | Wiebe | |
| 5,655,349 | A | 8/1997 | Ghali et al. | |
| 5,815,999 | A | 10/1998 | Williams | |
| 5,992,123 | A | 11/1999 | Kies | |
| 6,003,281 | A | 12/1999 | Pilakoutas | |
| 6,052,962 | A | 4/2000 | Ghali et al. | |
| D445,668 | S | 7/2001 | Hills, Sr. | |
| 6,327,832 | B1 | 12/2001 | Ernst et al. | |
| 6,385,930 | B1 | 5/2002 | Broms et al. | |
| 7,540,121 | B2 | 6/2009 | Haeussler | |
| 7,784,235 | B2 | 8/2010 | Cretti | |
| 2003/0154674 | A1 | 8/2003 | Matthaei et al. | |
| 2008/0263978 | A1 | 10/2008 | Abou-Saleh | |
| 2009/0188201 | A1 | 7/2009 | Ghali et al. | |

OTHER PUBLICATIONS

Office Action dated Dec. 13, 2011 in connection with U.S. Appl. No. 12/959,912.

A.H. Mattock, "Shear Transfer in Concrete Having Reinforcement At an Angle to the Shear Plane", 1973, p. 17-42.

Mark Ritchie, et al., "Seismic-Resistant Connections of Edge Columns with Prestressed Slabs", ACI Structural Journal, vol. 102, No. 2, Mar.-Apr. 2005, 10 pages.

Amin Ghali, "An Efficient Solution to Punching of Slabs", Concrete International, 1989, p. 50-54.

(Continued)

*Primary Examiner* — Basil Katcheves

(57) ABSTRACT

A reinforcing assembly includes multiple spaced-apart, longitudinally-extending support bars. The reinforcing assembly also includes multiple working members each independently connected to the support bars. The working members are oriented diagonally with respect to a longitudinal axis extending along the reinforcing assembly.

21 Claims, 8 Drawing Sheets

(56) References Cited

OTHER PUBLICATIONS

Zaher Abou Saleh, et al., "Punching Shear Capacity of Post-Tensioned Slab with Hairpin Shaped Reinforcements", PTI Journal, Jul. 2007, p. 39-48.

Adel A. Elgabry, et al., "Design of Stud-Shear Reinforcement for Slabs", ACI Structural Journal, vol. 87, No. 3, May-Jun. 1990, 12 pages.

Dr.-Ing. Josef Hegger, et al., "New reinforcement technology (Part 1)", Reinforcement technology, Aug. 2008, p. 4-13.

"Filigran Girder Systems," www.filigran.de, 11 pages.

Office Action dated Sep. 9, 2011 in connection with U.S. Appl. No. 12/959,912.

International Search Report dated Apr. 19, 2012 in connection with International Patent Application No. PCT/US2011/63299.

Written Opinion of International Searching Authority dated Apr. 19, 2012 in connection with International Patent Application No. PCT/US2011/63299.

* cited by examiner

REINFORCING ASSEMBLY AND REINFORCED STRUCTURE USING A REINFORCING ASSEMBLY

CROSS-REFERENCE TO RELATED APPLICATION AND PRIORITY CLAIM

This application claims priority under 35 U.S.C. §120 as a continuation-in-part of U.S. patent application Ser. No. 12/959,912 filed on Dec. 3, 2010, now U.S. Pat. No. 8,220,219 which is hereby incorporated by reference.

TECHNICAL FIELD

This disclosure relates generally to reinforcing structures. More specifically, this disclosure relates to a reinforcing assembly and a reinforced structure (such as a reinforced concrete structure) using a reinforcing assembly.

BACKGROUND

Commercial concrete is a mixture of cement, sand, and stone aggregate that, after the addition of water, slowly hardens together into a rigid structure. Stresses within concrete structures are typically of three primary types: compressive (where particles are crushed together), tensile (where particles are pulled apart), and shear (where one section of a structure is pressured to slide upon an adjacent section).

Unreinforced concrete structures often have good resistance to compressive stresses. However, any significant tensile stresses tend to cause undesirable cracking and separation since concrete is relatively weak in tension. To address this problem, concrete structures are typically reinforced by embedding in place within the rigid structures smaller solid members made of material(s) with high strength in tension. Typically, the smaller members include round steel bars with roughened surfaces, often called "reinforcing steel," "reinforcing bar," or "rebar." Reinforced concrete structures are available commercially in many shapes and sizes, such as slabs, beams, footings, and flat foundations.

Unfortunately, reinforced concrete structures are still highly susceptible to shear forces that create diagonal tensile stresses, which can result in structural failures. Cracking and/or breaking caused by shear forces tend to propagate throughout the stressed zone of a concrete structure. This problem is especially acute in concrete slabs or other supported structures that are supported by columns or other supporting structures. In these types of situations, a slab is subject to a concentration of stresses in a zone near a column, where the column tends to "punch" upward through the slab. The resulting shear forces create diagonal tensile stresses within the supported structure.

For this reason, supported structures are typically reinforced in the areas around columns or other supporting structures. This is done to prevent tensile failure, crack propagation, and consequent structural collapse. However, conventional approaches often provide reinforcement that helps restrain or minimize cracking or breaking only after the cracking or breaking has started. These conventional approaches are typically unable to prevent cracking or breaking from occurring in the first instance.

SUMMARY

This disclosure provides a reinforcing assembly and a reinforced structure (such as a reinforced concrete structure) using a reinforcing assembly.

In a first embodiment, a reinforcing assembly includes multiple spaced-apart, longitudinally-extending support bars. The reinforcing assembly also includes multiple working members each independently connected to the support bars. The working members are oriented diagonally with respect to a longitudinal axis extending along the reinforcing assembly.

In a second embodiment, a reinforced structure includes a supported structure and a reinforcing assembly embedded within the supported structure. The reinforcing assembly includes multiple spaced-apart, longitudinally-extending support bars. The reinforcing assembly also includes multiple working members each independently connected to the support bars. The working members are oriented diagonally with respect to a longitudinal axis extending along the reinforcing assembly.

In a third embodiment, a method includes forming a supported structure having a reinforcing assembly positioned within the supported structure. The reinforcing assembly includes multiple spaced-apart, longitudinally-extending support bars. The reinforcing assembly also includes multiple working members each independently connected to the support bars. The working members are oriented diagonally with respect to a longitudinal axis extending along the reinforcing assembly. The diagonally-oriented working members provide diagonal tension shear reinforcement in the supported structure.

Other technical features may be readily apparent to one skilled in the art from the following figures, descriptions, and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 13, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1:
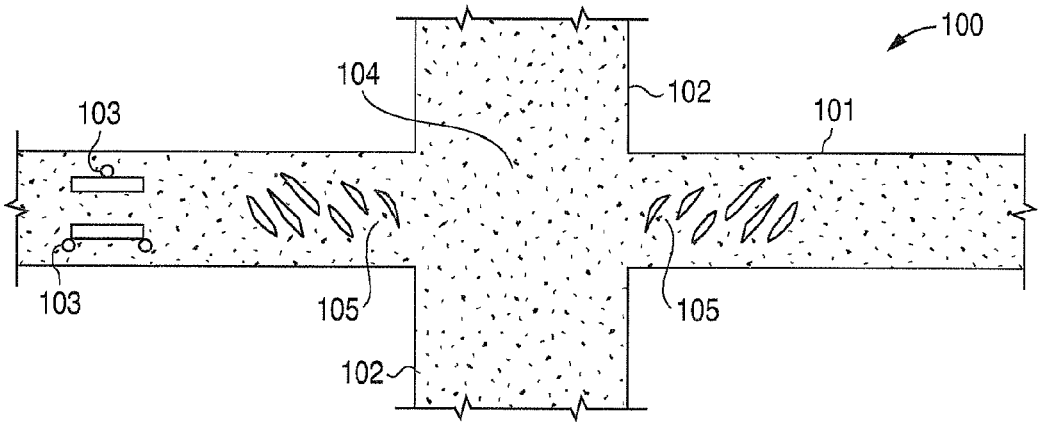
FIG. 1 illustrates an example of a cross-sectional view of a supported structure at an intersection with a supporting structure according to this disclosure.

FIG. 1 illustrates an example of a cross-sectional view 100 of a supported structure at an intersection with a supporting structure according to this disclosure. In this example, a slab structure 101 (the supported structure) is attached to a support column 102 (the supporting structure). The slab structure 101 can be formed from any suitable material(s), such as concrete or steel-supported concrete. The column 102 can also be formed from any suitable material(s), such as concrete or steel-supported concrete.

The slab structure 101 typically includes internal structural components that provide reinforcement. These internal components can represent any suitable structure(s) formed from any suitable material(s), such as reinforcing bar ("rebar") 103 formed of carbon steel or other material(s). The rebar 103 can be placed down the length of the slab structure 101 and/or across the width of the slab structure 101. In some embodiments, the rebar 103 extends across the top of the slab structure 101 (into and out of the view as shown), as well as across the bottom of the slab structure 101. However, both may not be needed, such as when rebar 103 is used across only the top of the slab structure 101.

In this example, a load or "reaction" area 104 of the slab structure 101 represents an area where large upward forces can exist, creating punching shear forces in the slab structure 101. Here, the punching shear forces are creating undesirable diagonal tension cracks 105 in the slab structure 101. The cracks 105 can form particularly in areas of high stress of the slab structure 101. Many times, the cracks 105 can form generally in the middle or upper area of the slab structure 101 and can propagate upward and downward, often in a diagonal direction, if not impeded. As described in more detail below, various reinforcing assemblies are disclosed here that can help to reduce or even eliminate the formation of cracks caused by shear forces in a slab structure 101 or other similarly supported structure.

Although FIG. 1 illustrates one example of a cross-sectional view 100 of a supported structure at an intersection with a supporting structure, various changes may be made to FIG. 1. For example, each of the components in FIG. 1 could have any suitable size, shape, and dimensions. Also, the reinforcing assemblies described below could be used in any other environment where shear forces affect a structure, such as with any suitable supported structure that is supported by any suitable supporting structure.

Figure 2:
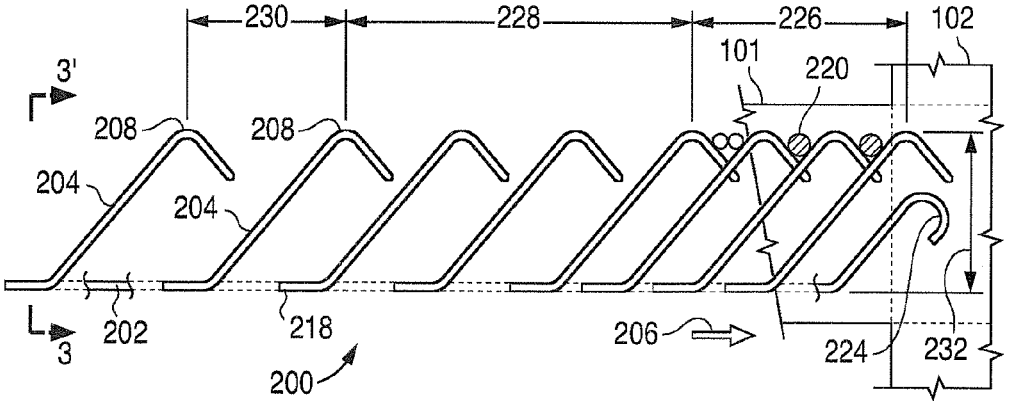
FIGS. 2 through 4 illustrate a first example of a reinforcing assembly according to this disclosure.
Figure 3:
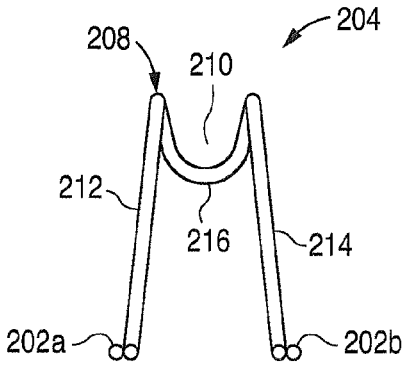
Figure 4:
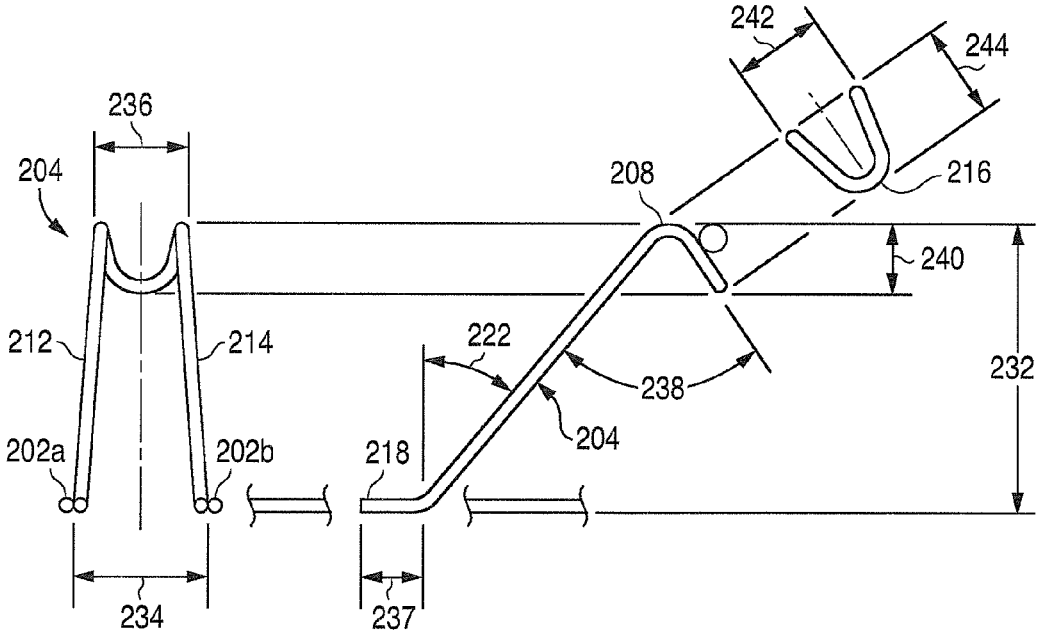

FIGS. 2 through 4 illustrate a first example of a reinforcing assembly 200 according to this disclosure. In particular, FIG. 2 is an elevation view of the reinforcing assembly 200, and FIG. 3 is a sectional view taken along lines 3-3' in FIG. 2. FIG. 4 illustrates section, elevation, and plan views of a working member of the reinforcing assembly 200. In these figures and the following description, it is assumed that the reinforcing assembly 200 is used in conjunction with the slab structure 101 and the support column 102. However, the reinforcing assembly 200 could be used with any other supported structure or any other supporting structure.

As shown in FIG. 2, the reinforcing assembly 200 includes two spaced-apart, longitudinally-extending support or carrier bars 202*a*-202*b* (referred to collectively as bars 202). In some embodiments, each of the support bars 202 could represent a single continuous bar, although support bars 202 formed from multiple connected segments could be used. Also, each of the support bars 202 could have any suitable cross-sectional shape. Multiple working members 204 are independently connected to the support bars 202. In some embodiments, each working member 204 could represent a single integral unit that is attached at two weld points to the support bars 202. The working members 204 and the support bars 202 can be formed from any suitable material(s), such as rebar. The rebar could have the smallest practical diameter (such as #3 rebar) and have a ribbed or knurled surface along its entire length.

FIG. 2 shows a side view of the working members 204, while FIG. 3 shows a front or rear view of the working members 204. As shown in FIG. 2, each working member 204 is oriented diagonally with respect to a longitudinal axis 206 that extends along the support bars 202. Through this diagonal orientation, the working members 204 can more effectively impede diagonal crack formation in the slab structure 101 and possibly even prevent the formation of cracks 105.

As shown in FIGS. 3 and 4, each working member 204 includes a top portion 208, which defines the upper extent of the working member 204. The top portion 208 is also the point from which a downwardly-extending hook portion 210 of the working member 204 extends. Each working member 204 includes first and second upstanding sides 212-214 and a central connecting section 216 that connects the upstanding sides 212-214. Each upstanding side 212-214 also has a connecting portion 218, which is generally parallel with the support bars 202. The connecting portions 218 can be welded or otherwise connected to the support bars 202 (such as to an inside face of the support bar 202).

The "turn-down" created by the hook portion 210 at the top of each working member 204 facilitates near full anchorage along the top of the slab structure 101. At the same time, the hook portion 210 at the top of each working member 204 can ensure that the reinforcing assembly 200 does not block rebar 220 in either direction (the rebar 220 typically is not part of the shear reinforcing assembly 200 itself). This configuration allows the uppermost portions of the working members 204 to extend to a close distance (such as 0.75 inches) from the top surface of the slab structure 101. The bottom of the reinforcing assembly 200 could be the same or similar distance (such as 0.75 inches) from the bottom surface of the slab structure 101. This can allow the working members 204 to engage substantially the full thickness of the slab structure 101 and provide full efficiency.

The central connecting section 216 of each working member 204 connects the upstanding sides 212-214 of that working member 204 to one another so that each working member 204 is an integral unit. The central connecting section 216 therefore provides a stabilizing connection between the two sides of each working member 204.

As noted above, each working member 204 is angled with respect to the support bars 202. More specifically, the upstanding sides 212-214 are angled with respect to the support bars 202. An angle 222 could have any suitable value, such as about 20° to about 70°. In particular embodiments, the angle 222 is about 45°. As shown in FIG. 4, this bend allows for a longitudinal weld between the support bars 202 and the connecting portions 218 of the working member 204. The weld may be extended as required to develop the full strength of the support bars 202. The weld can also be stressed longitudinally and thus is able to develop the full strength of the working members 204 and to provide full bottom anchorage.

As shown in FIG. 2, each longitudinally-extending support bar 202 can optionally terminate at the column 102 in a structure 224 that is bent upward and hooked. This structure 224 is designed to extend into the support column 102 and provide additional support and gripping action in an area of maximum stress and load transfer.

The working members 204 can be spaced along the support bars 202 at any suitable fixed or variable distance(s). In FIG. 2, the spacing between adjacent pairs of working members 204 along the length of the reinforcing assembly 200 varies in different sections 226-230. Here, the spacing between adjacent working members 204 in the first section 226 is closer than in the second section 228, and the spacing between adjacent working members 204 in the second section 228 is closer than in the third section 230. In particular embodiments, the spacing between adjacent working members 204 is about three or four inches in the first section 226, about five inches in the second section 228, and about six or seven inches in the third section 230.

Other progressively-increasing spacings could also be used. For example, each successive spacing away from the column 102 could be a fixed percentage larger than the preceding spacing, and no spacings (except possibly the first few spacings) could be equal. As another example, the spacings could vary incrementally in fractional-inch or other increments. In some embodiments, the smallest spacing between two working members 204 could be about three to about four inches, and the largest spacing between two working members 204 could be about ten inches.

The spacings and the lengths of the working members 204 for any particular installation could be based on various factors. Example factors include the thickness of the slab structure 101, the load to be placed on the slab structure 101, the strength of the concrete or other material(s) forming the slab structure 101, and the size of the column 102. In general, any technique for increasing the spacings between at least some of the adjacent pairs of working members 204 along the length of the reinforcing assembly 200 could be used. Note that the use of smaller spacings closer to the column 102 allows the reinforcing assembly 200 to provide greater reinforcement closer to the support column 102. However, variable spacing is not required in the reinforcing assembly 200.

The following are example values for other dimensions of the reinforcing assembly 200. The reinforcing assembly 200 could have a height 232 of about seven inches to about ten inches. The height 232 could be about 1.5 inches shorter than the height of the slab structure 101, allowing for about 0.75 inches on top and bottom of the reinforcing assembly 200. Each of the working members 204 could have a width 234 on bottom of about 4.25 inches and a width 236 on top of about 3.25 inches. The wider width at the bottom provides stability against overturning and can allow multiple assemblies to be stacked after fabrication (to reduce volume during shipping). Each connecting portion 218 could have a length 237 of about two inches. Each hook portion 210 could form an angle 238 of about 75° and extend downward at a distance 240 of about 2.25 inches. Each hook portion 210 could also have a width 242 of about 3.25 inches and a length 244 of about 3.125 inches. These dimensions are for illustration only.

As shown in FIGS. 2 through 4, each of the working members 204 can be bent into five different planes before being connected to the support bars 202. Automated machinery could be used to bend the rebar or other materials to form the working members 204, such as in a single pass.

The working members 204 are placed diagonally on the support bars 202 to engage any nascent crack 105 in the slab structure 101 at a 90° or near 90° angle with respect to the crack 105 itself, which provides improved or maximum efficiency in terms of aligning the working members 204 to directly oppose the diagonal tension (splitting) forces. With diagonal placement, each working member 204 traverses a much larger percentage of the potential crack zone per unit length as compared to a vertical orientation. The diagonal placement also enables each working member 204 to engage up to twice as many crack zones per unit. Further, the compact size and alignment of the working members 204 allow the working members 204 to penetrate upward, even between densely-packed top rebar concentrations, and to engage the full depth of structural slab thickness.

Although the use of small (roughened) rebar could mean that more working members are required per installation, this provides an advantage in that it allows a more dispersed distribution of the individual working members in concrete. As a result, the reinforcing can "blend" into the concrete material and act more as an integral part of the concrete itself.

Figure 5:
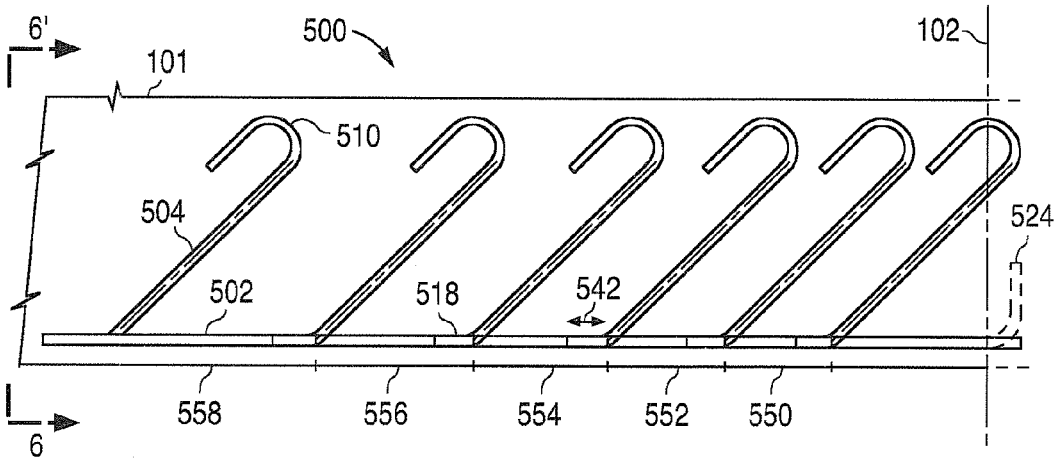
FIGS. 5 and 6 illustrate a second example of a reinforcing assembly according to this disclosure.
Figure 6:
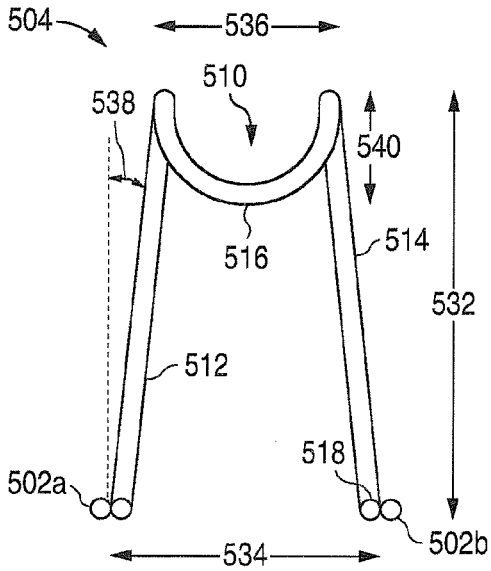

FIGS. 5 and 6 illustrate a second example of a reinforcing assembly 500 according to this disclosure. In particular, FIG. 5 is an elevation view of the reinforcing assembly 500, and FIG. 6 is a sectional view taken along lines 6-6' of FIG. 5. In these figures and the following description, it is again assumed that the reinforcing assembly 500 is used in conjunction with the slab structure 101 and the support column 102. However, the reinforcing assembly 500 could be used with any other supported structure or any other supporting structure.

The reinforcing assembly 500 includes multiple support bars 502*a*-502*b* (referred to collectively as bars 502) and multiple working members 504. The working members 504 are again oriented diagonally with respect to a longitudinal axis that extends along the support bars 502. Each working member 504 includes an upwardly-extending hook portion 510. Each working member 504 also includes first and second upstanding sides 512-514 and a central connecting section 516 that connects the upstanding sides 512-514. Each upstanding side 512-514 also has a connecting portion 518, which can be welded or otherwise connected to one of the support bars 502. The working members 504 are similar in structure to the working members 204, except the hook portions 510 of the working members 504 are made to hook upward instead of downward.

In this example, each of the support bars 502 can optionally terminate within the support column 102 in a structure 524 that is bent upward. Again, the structure 524 is designed to extend into the support column 102 and provide additional support and gripping action in an area of maximum stress and load transfer.

The following are example values for various dimensions and other characteristics of the reinforcing assembly 500. The support bars 502 and working members 504 can be formed from #3 rebar. The reinforcing assembly 500 could have a height 532 that is about 1.5 inches shorter than the height of the slab structure 101, allowing for about 0.75 inches on top and bottom of the reinforcing assembly 500. The reinforcing assembly 500 could, for example, have a height 532 of about 7.5 inches. Each of the working members 504 could have a width 534 on bottom of about 5.5 inches and a width 536 on top of about 2.5 inches. The upstanding sides 512-514 could be angled at an angle 538 of about 6°, and the hook portion 510 could extend downward at a distance 540 of about 1.5 inches. Each of the connecting portions 518 could have a length 542 of about 1.5 inches.

Once again, the spacings between adjacent working members 504 could be fixed or variable in any suitable manner. For instance, spacings 550-558 could be about 4.125 inches, about 4.375 inches, about five inches, about six inches, and about 7.5 inches, respectively. However, any other suitable spacing(s) could be used.

Figure 7:
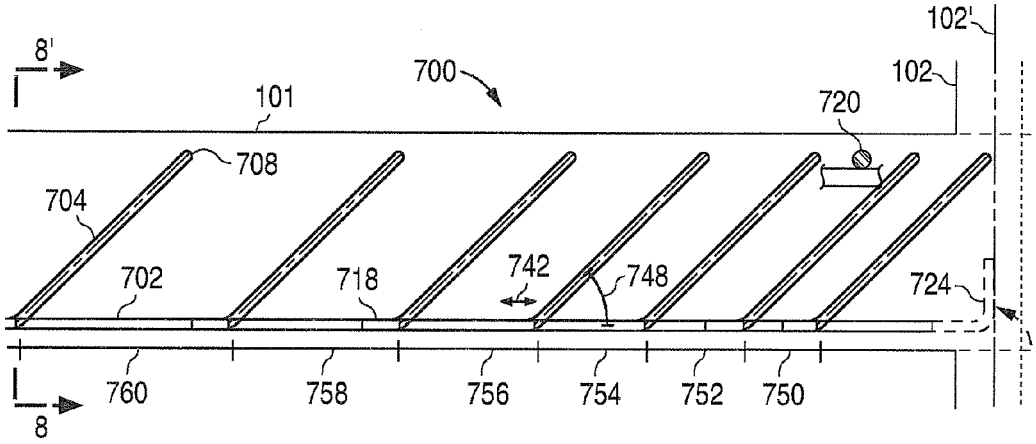
FIGS. 7 and 8 illustrate a third example of a reinforcing assembly according to this disclosure.
Figure 8:
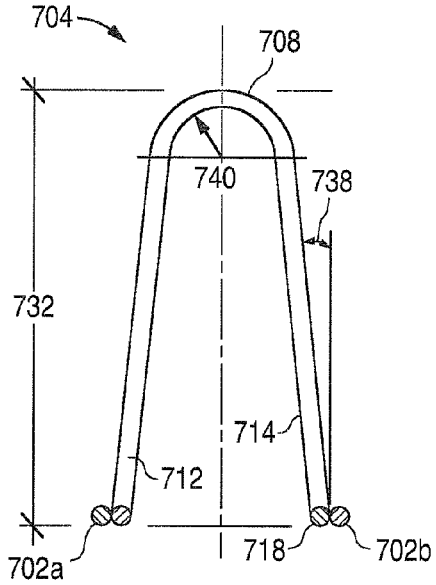

FIGS. 7 and 8 illustrate a third example of a reinforcing assembly 700 according to this disclosure. In particular, FIG. 7 is an elevation view of the reinforcing assembly 700, and FIG. 8 is a sectional view taken along lines 8-8' of FIG. 8. In these figures and the following description, it is once again assumed that the reinforcing assembly 800 is used in conjunction with the slab structure 101 and the support column 102. In this example, the support column 102 is shown to include column rebar 102'. However, the reinforcing assembly 800 could be used with any other supported structure or any other supporting structure.

The reinforcing assembly 700 includes multiple support bars 702*a*-702*b* (referred to collectively as bars 702) and multiple working members 704. The working members 704 are again oriented diagonally with respect to a longitudinal axis that extends along the support bars 702. Each working member 704 includes a top portion 708, first and second upstanding sides 712-714, and a central connecting section 716 that connects the upstanding sides 712-714. Unlike the reinforcing assemblies 200 and 500, the working members 704 here lack a longitudinal hook portion, and the top portion 708 is substantially planar with the upstanding sides 712-714. Each upstanding side 712-714 has a connecting portion 718, which can be welded or otherwise connected to one of the support bars 702.

This embodiment of the reinforcing assembly can be simpler to manufacture since the working members 704 require fewer bends than the assemblies shown in FIGS. 2 and 5. Also, this embodiment of the reinforcing assembly could be more easily integrated with rebar 720 in the slab structure 101. The rebar 720 can be placed between the working members 704 in one direction and, if desired, next to or through the loops formed by the top portions 708 of the working members 704 in the other direction.

In this example, each of the support bars 702 can optionally terminate within the support column 102 in a structure 724 that is bent upward. Once again, the structure 724 is designed to extend into the support column 102 and provide additional support and gripping action in an area of maximum stress and load transfer.

The following are example values for various dimensions and other characteristics of the reinforcing assembly 700. The support bars 702 and working members 704 can be formed from #3 rebar. The reinforcing assembly 700 could have a height 732 that is about 1.5 inches shorter than the height of the slab structure 101, allowing for about 0.75 inches on top and bottom of the reinforcing assembly 700. Each of the working members 704 could have upstanding sides 712-714 at an angle 738 of about 6°, and the top portion 708 could have an inner radius of curvature 740 of about one inch. Each of the working members 704 could also have connecting portions 718 with a length 742 of about 1.5 inches, and the working members 704 could be placed at an angle 748 of about 45°±25° on the support bars 702.

The spacings between adjacent working members 704 could be fixed or variable in any suitable manner. For instance, the spacings 750-760 could be about three inches, about 3.5 inches, about 4.25 inches, about 5.25 inches, about 6.5 inches, and about eight inches, respectively. However, any other suitable spacing(s) could be used. Moreover, since the working members 704 lack longitudinal hook structures, a closer spacing could be achieved in the reinforcing assembly 700.

Figure 9:
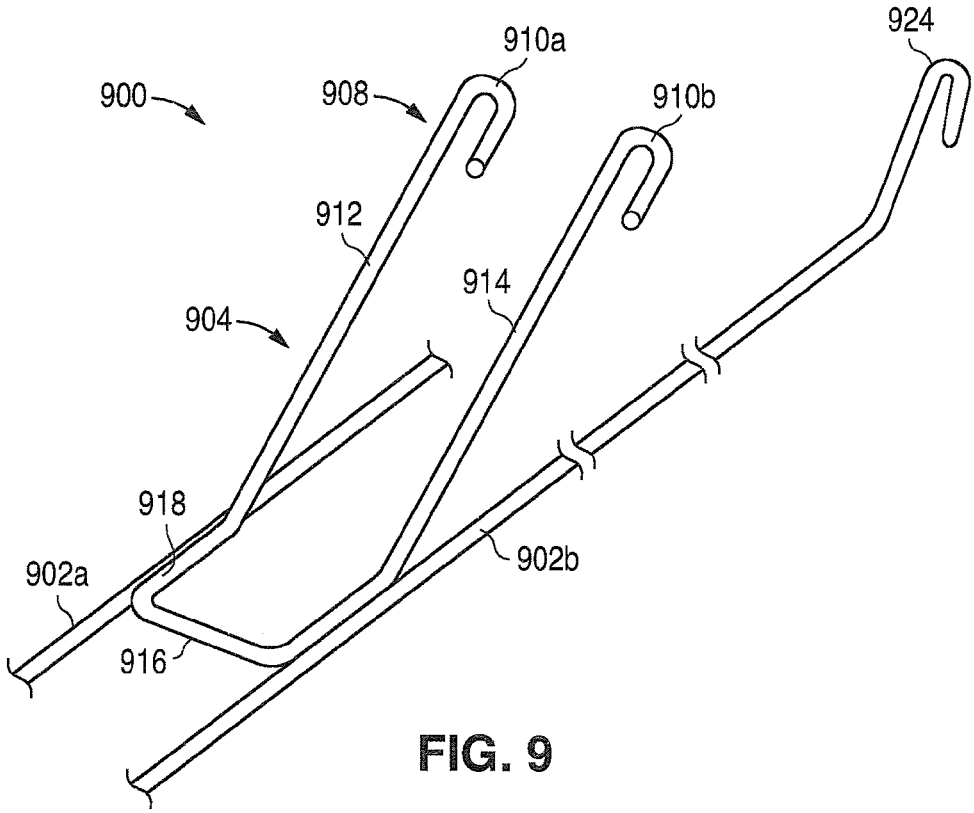
FIGS. 9 and 10 illustrate a fourth example of a reinforcing assembly according to this disclosure.
Figure 10:
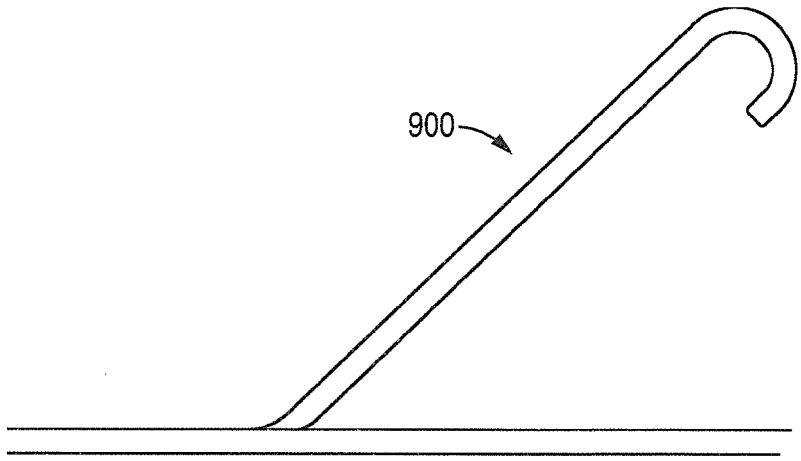

FIGS. 9 and 10 illustrate a fourth example of reinforcing assembly 900 according to this disclosure. In particular, FIG. 9 is an offset view of the reinforcing assembly 900, and FIG. 10 is an elevation view of a working member of the reinforcing assembly 900.

The reinforcing assembly 900 includes multiple support bars 902*a*-902*b* (referred to collectively as bars 902) and multiple working members 904 (although a single working member 904 is shown in FIG. 9). Each working member 904 includes a top portion 908, first and second upstanding sides 912-914, and a central connecting section 916 that connects the upstanding sides 912-914. However, in this embodiment, the central connecting section 916 connects the lower ends of the upstanding sides 912-914, the upstanding sides 912-914 are unconnected at the top portion 908. The upstanding sides 912-914 continue to be oriented diagonally with respect to a longitudinal axis that extends along the support bars 902. Each upstanding side 912-914 could have a connecting portion 918, which can be welded or otherwise connected to one of the support bars 902.

In this example, the upstanding sides 912-914 of the working member 904 include two hook portions 910*a*-910*b*. The hook portions 910*a*-910*b* hook downward in this embodiment, although the hook portions 910*a*-910*b* could also hook upward similar to FIG. 5. The hook portions 910*a*-910*b* are not connected to each other since the central connecting section 916 is connected to the lower ends of the upstanding sides 912-914. Note, however, that multiple central connecting sections 916 could be used, one on bottom of the upstanding sides 912-914 and one connecting the hook portions 910*a*-910*b*.

The following are example values for various dimensions and other characteristics of the reinforcing assembly 900. The support bars 902 and working members 904 can be formed from #3 rebar. The reinforcing assembly 900 could have a height that is about 1.5 inches shorter than the height of the slab structure 101, allowing for about 0.75 inches on top and bottom of the reinforcing assembly 900. The upstanding sides 912-914 could be separated by about four inches, and each connecting portion 918 could be about 1.25 inches in length (with a bottom filet weld of about one inch long). Each of the hook portions 910*a*-910*b* could have a radius of curvature of about 0.75 inches and could extend downward about two inches. The working members 904 could be placed at an angle of about 45°±25° on the support bars 902.

In particular embodiments, each working member in the above-described reinforcing assemblies is oriented diagonally, has a knurled or other rough surface (possibly along its full length), and is formed of a small diameter rebar material (such as #3 rebar). This size of rebar could have the highest ratio of surface area-to-cross sectional area (thus increasing its ability to bond most effectively to concrete around it, which can be very useful since the confinement of the slab thickness may severely limit the length of the working members) while being stiff enough to maintain its shape during concrete placement. The use of #3 rebar is not a requirement, however, and other types of materials (such as #4 rebar or #5 rebar) may be used. Moreover, while the reinforcing assemblies are illustrated as having multiple diagonal working members whose spacing from one another varies progressively from an inner to an outer end (relative to the supporting structure), this is not a requirement, either. A reinforcing assembly with at least one diagonal working member having the structural characteristics described and illustrated above is within the scope of this disclosure.

The reinforcing assemblies described above can provide various advantages over conventional approaches (depending on the implementation). The angled (diagonal) orientation of the working members places them at approximately a perpendicular position to potential diagonal-stress punching shear cracks. The ribbed or other roughened surfaces of the working members provide improved or maximum efficiency in engaging concrete at the points of maximum stress, helping to prevent cracks from beginning in the first instance. Because the reinforcing assemblies can inhibit cracks at the points of maximum stress and because the reinforcing assemblies can provide similar reinforcement that crosses the crack zones above and below these points and not far from them, any crack (if it does occur) cannot propagate (extend) upward or downward. If cracking does not occur or if it is held to a very narrow width, the very significant strength of the concrete continues to maintain its integrity and work as a single solid unit as it was designed to do, thereby enabling the supported structure (in which a reinforcing assembly is embedded) to carry maximum shear loads. The rebar and the concrete thus work together, and their respective strengths are additive, rather than (as in the prior art) the concrete failing and transferring all of its load-carrying ability to smooth steel studs (such as in the STUD-RAIL system) or similar reinforcing.

The reinforcement provided by each angled working member develops a bond with the concrete with which it is in contact, thus preventing crack origination and/or propagation. This is because the working member bonds to the concrete on both sides on the crack zone and prevents those concrete segments from moving apart from one another. Thus, the cracking process cannot begin under usual loads. The rebar works with the concrete and supplements it, rather than simply going to work after the concrete has already failed (as in the STUD-RAIL system).

The reinforcing assemblies are easy to manufacture. Each assembly can be made entirely of available materials (such as #3 rebar), and those pieces are readily bent and welded into the assembly using conventional manufacturing techniques (which can be automated).

Although FIGS. 2 through 10 illustrate examples of reinforcing assemblies for use with concrete structures or other supported structures, various changes may be made to FIGS. 2 through 10. For example, the relative sizes and dimensions of components in each figure are for illustration only. Also, features in one or more of these figures could be used in one or more others of these figures.

Figure 11:
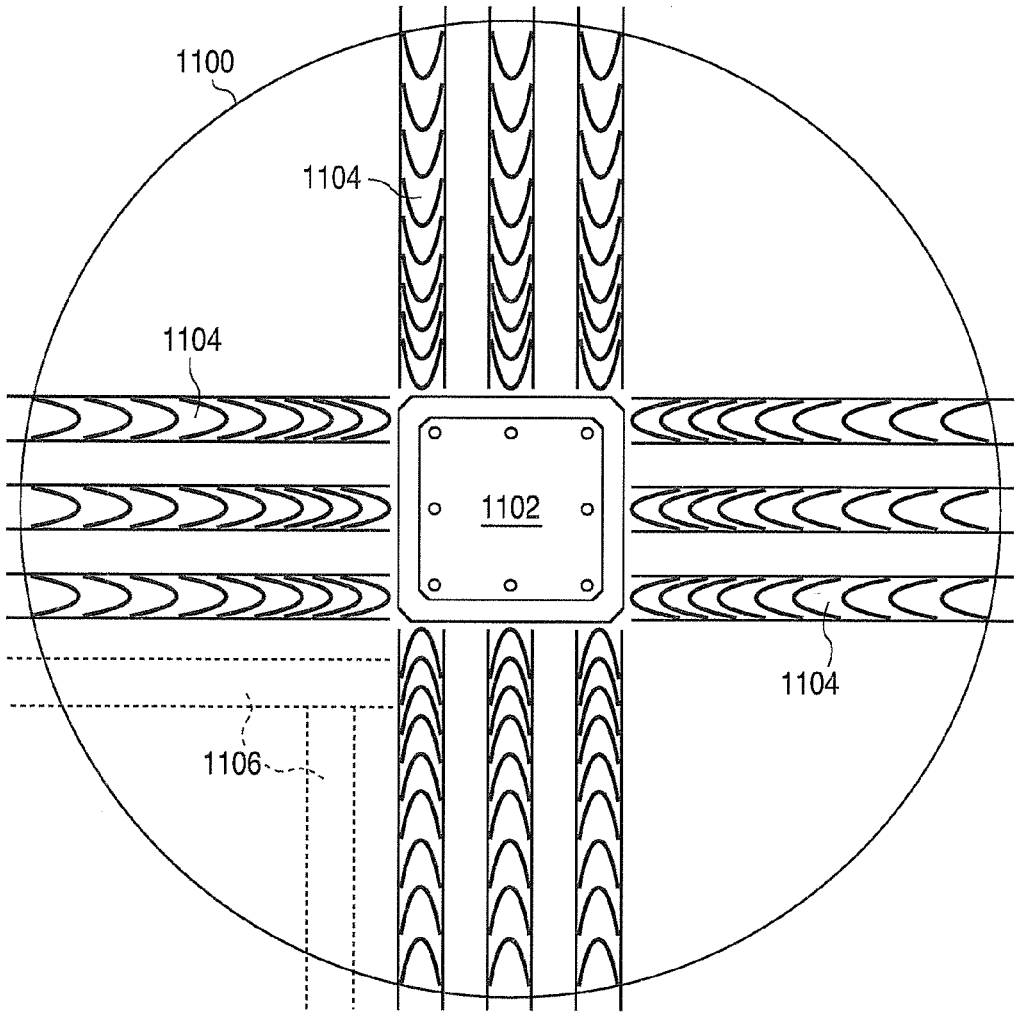
FIGS. 11 through 13 illustrate examples of supported structures containing reinforcing assemblies according to this disclosure.
Figure 12A:
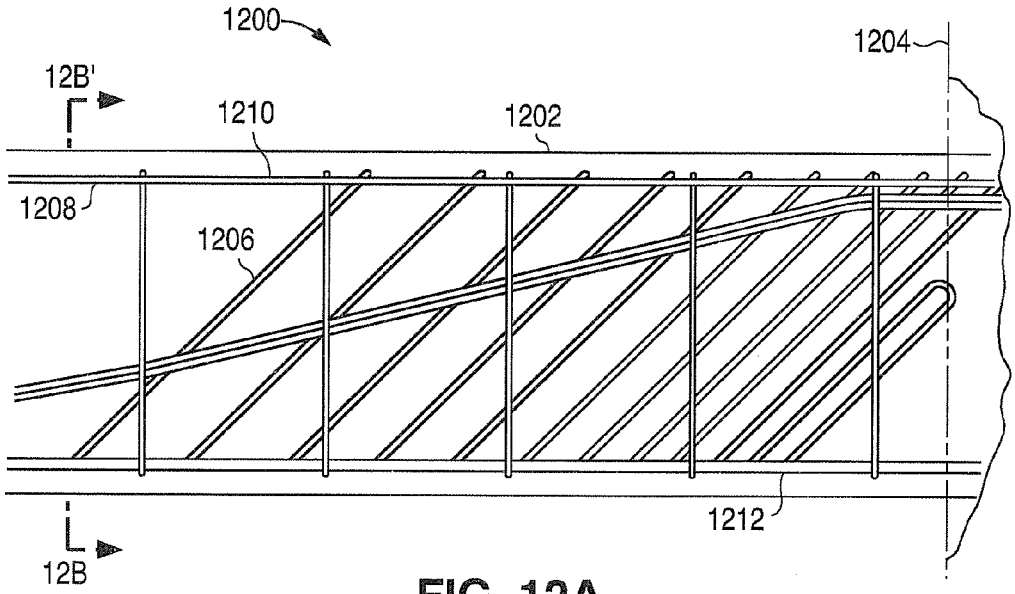
Figure 12B:
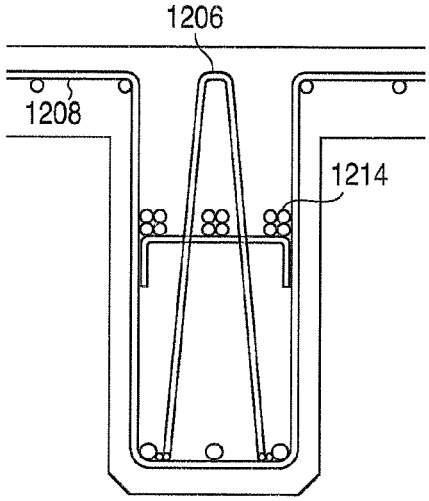
Figure 13:
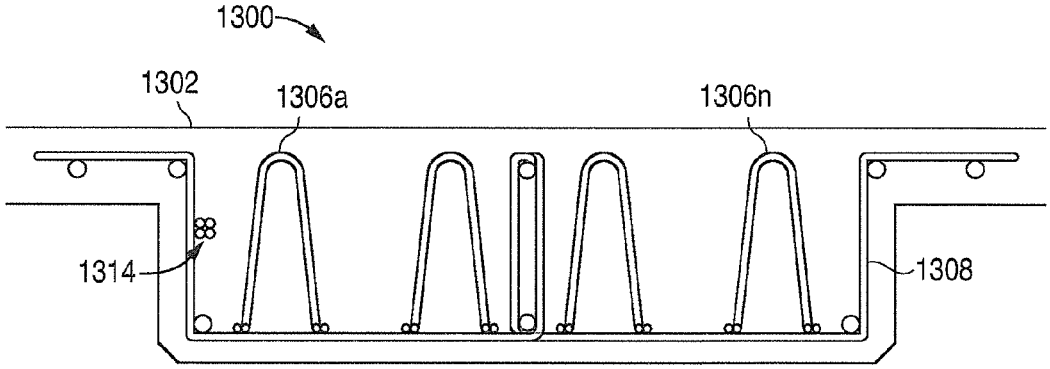

FIGS. 11 through 13 illustrate examples of supported structures containing reinforcing assemblies according to this disclosure. FIG. 11 illustrates an example plan view of a supported structure 1100 containing multiple reinforcing assemblies. In this example, the supported structure 1100 represents a slab or other structure that is supported by a column or other supporting structure 1102. A concrete column is typically about 16 to about 24 inches square, although other sizes and shapes could be used. Note that a column is but one example type of supporting structure 1102 that could be used here.

In this example embodiment, three reinforcing assemblies 1104 are positioned side-by-side at each orthogonal position around the supporting structure 1102. The reinforcing assemblies 1104 could represent any of the reinforcing assemblies described above, and the reinforcing assemblies 1104 may or may not be identical in structure. The reinforcing assemblies 1104 extend outwardly to provide an overall zone of reinforcement around the supporting structure 1102. The reinforcing assemblies 1104 could be between about two feet to about four feet in length, although any other suitable length(s) could be used. Note that one or more additional reinforcing assemblies 1106 could be used in one or both directions for high-stress conditions.

FIGS. 12A and 12B illustrate another example supported structure 1200 containing a reinforcing assembly. In this example, the supported structure 1200 includes a long-span deep beam 1202 that is supported by a column or other supporting structure 1204. Here, the beam 1202 includes a reinforcing assembly 1206 within a beam stirrup 1208. The reinforcing assembly 1206 could represent any of the reinforcing assemblies described above. In this example, a single reinforcing assembly 1206 is placed within the beam stirrup 1208, which forms a U-shaped recess in which the reinforcing assembly 1206 is placed. For additional support, the beam 1202 also includes top and bottom rebar 1210-1212, as well as post-tensioning strands 1214 (which could be formed from wire rope of extremely high-tensile steel that does not bond to concrete).

FIG. 13 illustrates yet another example supported structure 1300 containing multiple reinforcing assemblies. In this example, the supported structure 1300 includes a wide shallow beam 1302, which can be supported by a column or other supporting structure. Here, the beam 1302 includes multiple reinforcing assemblies 1306*a*-1306*n* within a beam stirrup 1308. The reinforcing assemblies 1306*a*-1306*n* could represent any of the reinforcing assemblies described above and need not all be identical. In this example, the beam stirrup 1308 forms a large U-shaped recess in which the reinforcing assemblies 1306*a*-1306*n* are placed. For additional support, the beam 1302 could include additional structures, such as top or bottom rebar or post-tensioning strands 1314.

Although FIGS. 11 through 13 illustrate examples of supported structures containing reinforcing assemblies, various changes may be made to FIGS. 11 through 13. For example, any number of reinforcing assemblies could be used in each structure. Also, any other supported structure(s) could be used with the reinforcing assemblies. For instance, a reinforced concrete structure includes any structure (such as a slab, beam, footing, flat foundation, or the like) that includes at least one reinforcing assembly.

It may be advantageous to set forth definitions of certain words and phrases used throughout this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A reinforcing assembly for use in a reinforced concrete structure, the reinforcing assembly comprising:

multiple spaced-apart, longitudinally-extending support bars; and multiple working members each independently connected to the support bars, the working members oriented diagonally with respect to a longitudinal axis extending along the support bars;

wherein the working members are arranged so that a lower portion of one working member is physically located directly between an upper portion of a neighboring working member and each support bar in a direction perpendicular to the longitudinal axis;

wherein the support bars and the working members comprise rebar, the working members welded to the support bars; and wherein each working member comprises upwardly-extending sides and a connecting portion that couples the upwardly-extending sides.

2. The reinforcing assembly of claim 1, wherein the connecting portion of each working member includes a hook portion at upper ends of the upwardly-extending sides.

3. The reinforcing assembly of claim 1, wherein:

each working member includes separate hook portions at upper ends of the upwardly-extending sides; and the connecting section of each working member connects the upwardly-extending sides at lower ends of the upwardly-extending sides.

4. The reinforcing assembly of claim 1, wherein the connecting portion in each working member includes a loop connecting the upwardly-extending sides, the upwardly-extending sides and the loop being substantially planar.

5. The reinforcing assembly of claim 1, wherein each upwardly-extending side has, at a lower end, a second connecting portion that connects the upwardly-extending side to one of the support bars.

6. The reinforcing assembly of claim 1, wherein the support bars and the working members comprise #3 rebar.

7. The reinforcing assembly of claim 1, wherein the working members are oriented at about 45° with respect to the longitudinal axis.

8. The reinforcing assembly of claim 1, wherein each support bar comprises a section that is bent upward and that is configured to be anchored within a supporting structure.

9. The reinforcing assembly of claim 1, wherein at least some of the working members are spaced a variable distance apart.

10. The reinforcing assembly of claim 2, wherein the hook portion of each working member comprises one of: an upwardly-extending hook portion and a downwardly-extending hook portion.

11. The reinforcing assembly of claim 1, wherein:

the upwardly-extending sides of each working member are substantially straight; and the upwardly-extending sides of all working members connected to the support bars are substantially parallel with each other when the reinforcing assembly is viewed from a side.

12. A reinforced structure comprising:

a concrete supported structure; and a reinforcing assembly embedded within the concrete supported structure, wherein the reinforcing assembly comprises:

multiple spaced-apart, longitudinally-extending support bars; and multiple working members each independently connected to the support bars, the working members oriented diagonally with respect to a longitudinal axis extending along the support bars;

wherein the working members are arranged so that a lower portion of one working member is physically located directly between an upper portion of a neighboring working member and each support bar in a direction perpendicular to the longitudinal axis;

wherein the support bars and the working members comprise rebar, the working members welded to the support bars; and wherein each working member comprises upwardly-extending sides and a connecting portion that couples the upwardly-extending sides.

13. The reinforced structure of claim 12, wherein the connecting portion of each working member includes a hook portion at upper ends of the upwardly-extending sides.

14. The reinforced structure of claim 13, wherein the hook portion of each working member comprises one of: an upwardly-extending hook portion and a downwardly-extending hook portion.

15. The reinforced structure of claim 12, wherein:

each working member includes separate hook portions at upper ends of the upwardly-extending sides; and the connecting section of each working member connects the upwardly-extending sides at lower ends of the upwardly-extending sides.

16. The reinforced structure of claim 12, wherein the connecting portion in each working member includes a loop connecting the upwardly-extending sides, the upwardly-extending sides and the loop being substantially planar.

17. The reinforced structure of claim 12, wherein each upwardly-extending side has, at a lower end, a second connecting portion that connects the upwardly-extending side to one of the support bars.

18. The reinforced structure of claim 12, wherein the supported structure comprises a concrete slab.

19. The reinforced structure of claim 18, wherein the concrete slab is supported by at least one concrete column.

20. The reinforced structure of claim 12, wherein each support bar comprises a section that is bent upward and that is configured to be anchored within a supporting structure.

21. A method comprising:

forming a concrete supported structure having a reinforcing assembly positioned within the supported structure, the reinforcing assembly comprising:

multiple spaced-apart, longitudinally-extending support bars; and multiple working members each independently connected to the support bars, the working members oriented diagonally with respect to a longitudinal axis extending along the support bars;

wherein the working members are arranged so that a lower portion of one working member is physically located directly between an upper portion of a neighboring working member and each support bar in a direction perpendicular to the longitudinal axis;

wherein the support bars and the working members comprise rebar, the working members welded to the support bars; and wherein each working member comprises upwardly-extending sides and a connecting portion that couples the upwardly-extending sides.

* * * * *